US010226709B2

(12) United States Patent
Jones

(10) Patent No.: US 10,226,709 B2
(45) Date of Patent: Mar. 12, 2019

(54) SPINNING AMUSEMENT DEVICE

(71) Applicant: Douglas Jones, Asheville, NC (US)

(72) Inventor: Douglas Jones, Asheville, NC (US)

( * ) Notice: Subject to any disclaimer, the term of this patent is extended or adjusted under 35 U.S.C. 154(b) by 0 days.

(21) Appl. No.: 15/686,441

(22) Filed: Aug. 25, 2017

(65) Prior Publication Data

US 2018/0056198 A1 Mar. 1, 2018

Related U.S. Application Data

(60) Provisional application No. 62/380,445, filed on Aug. 28, 2016.

(51) Int. Cl.

| | |
|---|---|
| ***A63G 1/28*** | (2006.01) |
| ***A63H 33/00*** | (2006.01) |
| ***A63G 1/00*** | (2006.01) |

(52) U.S. Cl.

CPC ..... *A63G 1/28* (2013.01); *A63G 1/00* (2013.01); *A63H 33/00* (2013.01)

(58) Field of Classification Search

CPC . A63G 9/00; A63G 9/16; A63H 33/00; A63H 33/006; A61D 1/00; A61D 15/00; A61D 15/04; A61G 1/00; A47D 13/025

USPC ..... 472/118–125, 106, 108, 133, 135; 446/26–28; 224/158

See application file for complete search history.

(56) References Cited

U.S. PATENT DOCUMENTS

| | | | | |
|---|---|---|---|---|
| 1,769,199 | A * | 7/1930 | Baxter | A63G 11/00 472/4 |
| 2,113,488 | A * | 4/1938 | Milton | A63G 11/00 403/143 |
| 4,037,764 | A * | 7/1977 | Almosnino | A47D 13/025 224/160 |
| 4,877,238 | A | 10/1989 | Barrett | |
| 5,289,959 | A * | 3/1994 | Beeley | A61G 1/00 224/158 |
| 5,343,980 | A * | 9/1994 | Elfanbaum | A41D 1/00 182/194 |
| 5,674,159 | A | 10/1997 | Davidson | |
| 5,931,534 | A | 8/1999 | Nutter | |
| 7,175,535 | B1 * | 2/2007 | Marmentini | A47D 13/025 297/273 |
| 8,636,181 | B2 * | 1/2014 | Gunter | A47D 13/025 224/158 |
| 9,038,868 | B2 | 5/2015 | Poiani | |
| 9,084,940 | B2 | 7/2015 | Norquist et al. | |

(Continued)

*Primary Examiner* — Kien Nguyen

(74) *Attorney, Agent, or Firm* — Patentfile, LLC; Bradley C. Fach; Steven R. Kick

(57) ABSTRACT

A spinning amusement device is provided which may include a first arm coupled to an opposing second arm. A neck aperture may be disposed centrally between the first arm and the second arm. A first seat may be coupled to the first arm, and a second seat may be coupled to the second arm. Preferably, the device may be used by an adult user who may position their neck in the neck aperture, a first child user received in the first seat in a seated position, and a second child received in the second seat also in a seated position. The adult user may rotate the device, preferably by rotating their own body with the first arm and second arm, and the two children may therefore be spun or rotated while the majority of the centrifugal force of the children is borne by the device and by the children which are in a seated position.

19 Claims, 5 Drawing Sheets

(56) References Cited

U.S. PATENT DOCUMENTS

| | | | |
|---|---|---|---|
| 9,533,231 | B2 | 1/2017 | Peres et al. |
| 9,700,152 | B2 | 7/2017 | Telford et al. |
| 9,713,391 | B2 | 7/2017 | Telford et al. |
| 2005/0045674 | A1 | 3/2005 | Rehbein |

* cited by examiner

SPINNING AMUSEMENT DEVICE

CROSS REFERENCE TO RELATED APPLICATIONS

This application claims priority to and the benefit of the filing date of U.S. Provisional Application No. 62/380,445 filed on Aug. 28, 2016, entitled "APPARATUS FOR SPINNING CHILDREN IN A CIRCLE", which is hereby incorporated by reference in its entirety.

FIELD OF THE INVENTION

This patent specification relates to the field of amusement devices. More specifically, this patent specification relates to a device for facilitating the ability of a user to provide amusement through spinning movement to other users that are received by the device.

BACKGROUND

Children like to be spun in a circle by an adult. The traditional way to do this is for the adult to hold the child by both arms, or by one arm and one leg. The child is lifted off the ground and spun in a circle around the adult. After a time, the adult slows down the rotation and gently puts the child back on the ground.

There are several drawbacks to the above described traditional method of spinning. First, the full centrifugal force of the spin is placed on the adult's arms and on the child's arms/legs. This results in significant physical stress to joints, tendons and muscles for both the adult and the child; and it significantly limits the length of time the adult and child can engage in this activity. Second, only one child at a time can be given a spin-ride. Third, because the traditional method of spinning requires the adult to directly grab the limbs of the child, there is a danger of the adult's grip slipping causing injury to the child.

Therefore a need exists for novel amusement devices which facilitate the ability of adults to spin children. A further need exists for novel amusement devices for spinning children which do not significantly stress the joints, tendons and muscles of the adults and children. There is also a need for novel amusement devices for spinning children which enable more than one child to be spun by an adult. Finally, a need exists for novel amusement devices for spinning children which eliminate the need for the adult to directly grab the limbs of the child, thereby eliminating the danger of the adult's grip slipping and causing injury to the child.

BRIEF SUMMARY OF THE INVENTION

A spinning amusement device is provided. In some embodiments, the device may include a first arm coupled to an opposing second arm. A neck aperture may be disposed centrally between the first arm and the second arm. A first seat may be coupled to the first arm, and a second seat may be coupled to the second arm. Preferably, the device may be used by an adult user who may position their neck in the neck aperture, a first child user who may be received in the first seat in a seated position, and a second child who may be received in the second seat also in a seated position. The adult user may rotate the device, preferably by rotating their own body with the first arm and second arm, and the two children may therefore be spun or rotated while the majority of the centrifugal force of the children is borne by the device and by the children which are in a seated position.

In further embodiments, the device may include a first arm coupled to an opposing second arm. A neck aperture disposed centrally between the first arm and the second arm. A first seat may be coupled to the first arm, and the first seat may have a first seat wall defining a first seat cavity. A second seat may be coupled to the second arm, and the second seat may have a second seat wall defining a second seat cavity. A first handle may be positioned proximate to the first seat, and a second handle may be positioned proximate to the second seat. Preferably, an adult user may grasp the handles to facilitate the ability of the adult user to control the movement of the arms, such as when a child is received in a seat of the device.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
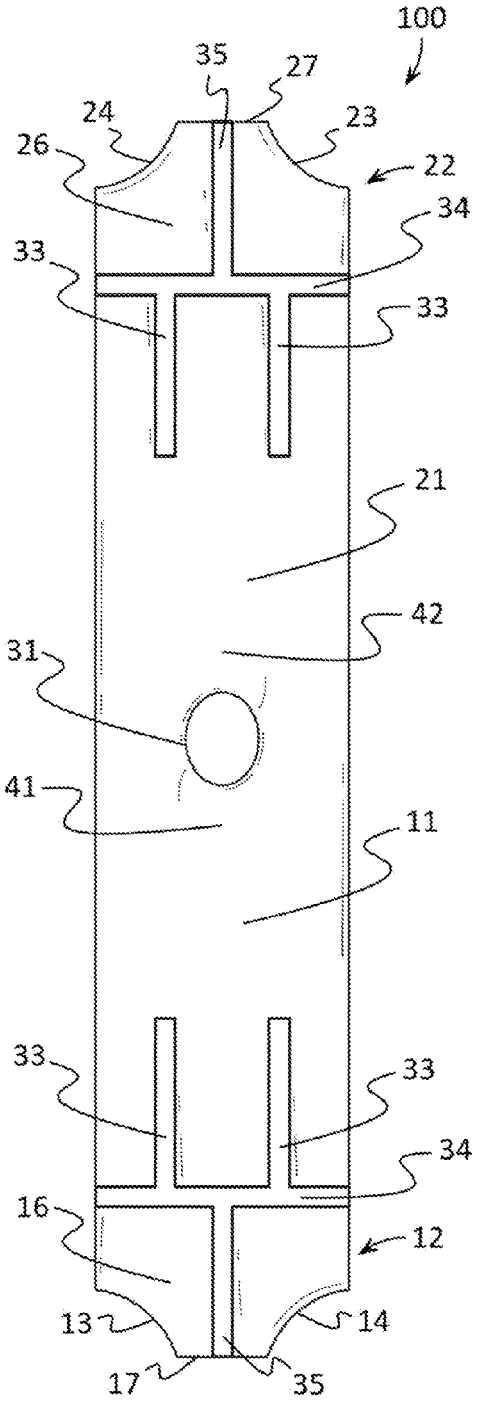
FIG. 1 depicts a top plan view of an example of a spinning amusement device according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

A new device for facilitating the ability of a user to provide spinning movement as amusement to other users that are received by the device is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

The present invention will now be described by example and through referencing the appended figures representing preferred and alternative embodiments. FIGS. 1-7 illustrate examples of a spinning amusement device ("the device") 100 according to various embodiments. In some embodiments, the device 100 may comprise a first arm 11 coupled to an opposing second arm 21. A neck aperture 31 may be disposed centrally between the first arm 11 and second arm 21. A first seat 12 may be coupled to the first arm 11, and a second seat 22 may be coupled to the second arm 21. Preferably, the device may comprise one or more handles 32 which may positioned proximate to each seat 12, 22. In some embodiments, the device may be used by an adult user who may position their neck in the neck aperture 31, a first child user who may be received in the first seat 12 in a seated position, and a second child who may be received in the second seat 22 also in a seated position. The adult user may rotate the device, preferably by rotating their own body and by controlling the handles 32, and the two children may therefore be spun or rotated while the majority of the centrifugal force of the children is borne by the device 100 and by the children which are in a seated position.

Figure 2:
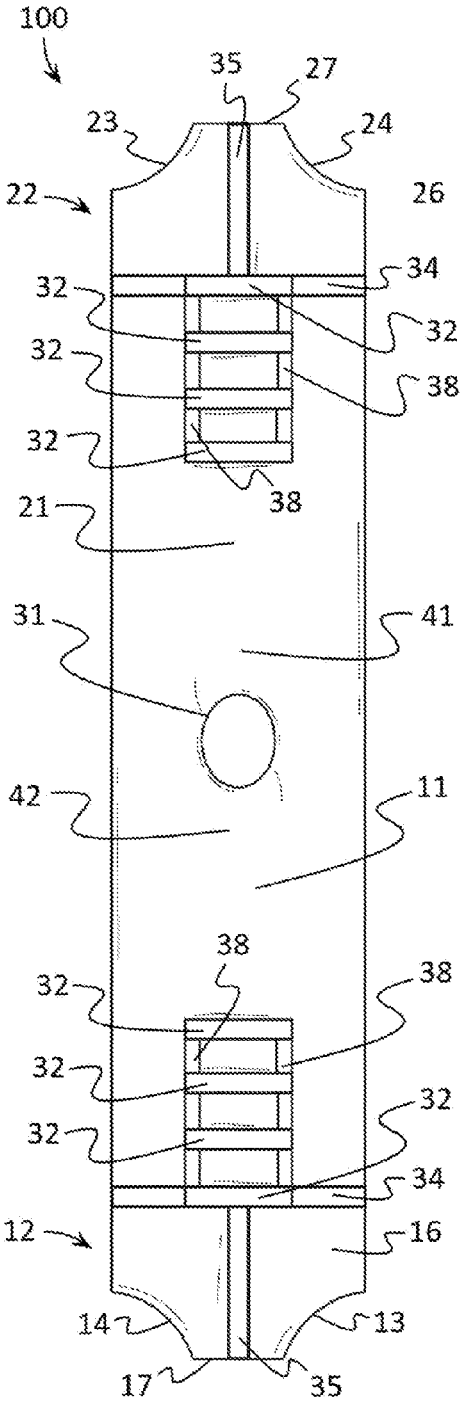
FIG. 2 illustrates a bottom plan view of an example of a spinning amusement device according to various embodiments described herein.
Figure 3:
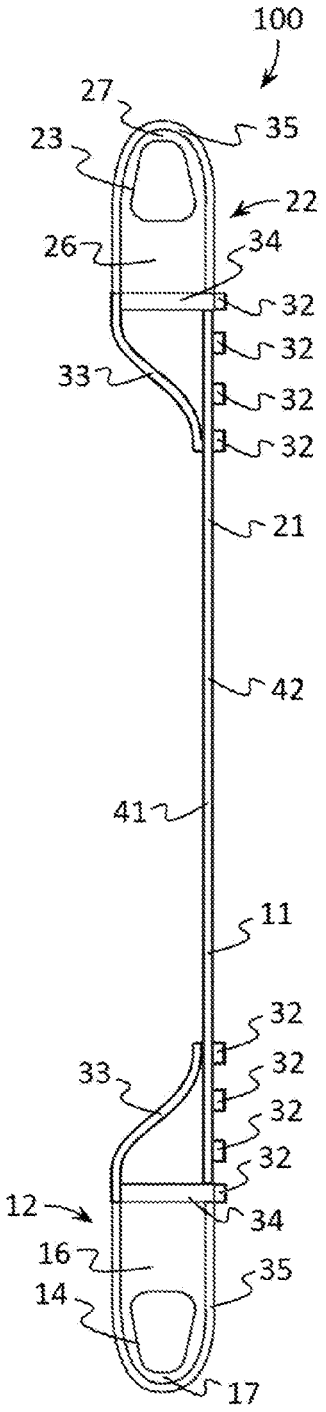
FIG. 3 shows a first side elevation view of an example of a spinning amusement device according to various embodiments described herein.
Figure 4:
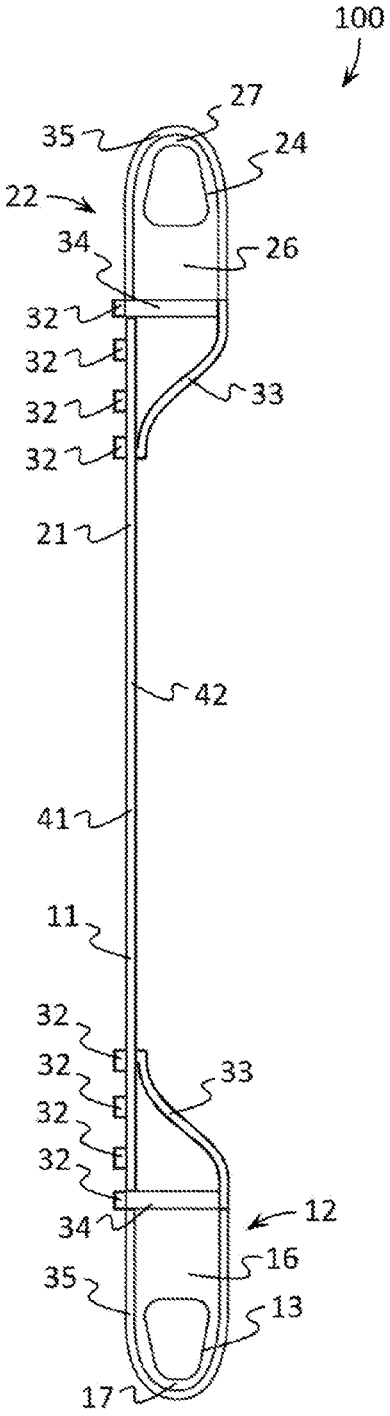
FIG. 4 depicts a second or opposing side elevation view of an example of a spinning amusement device according to various embodiments described herein.
Figure 5:
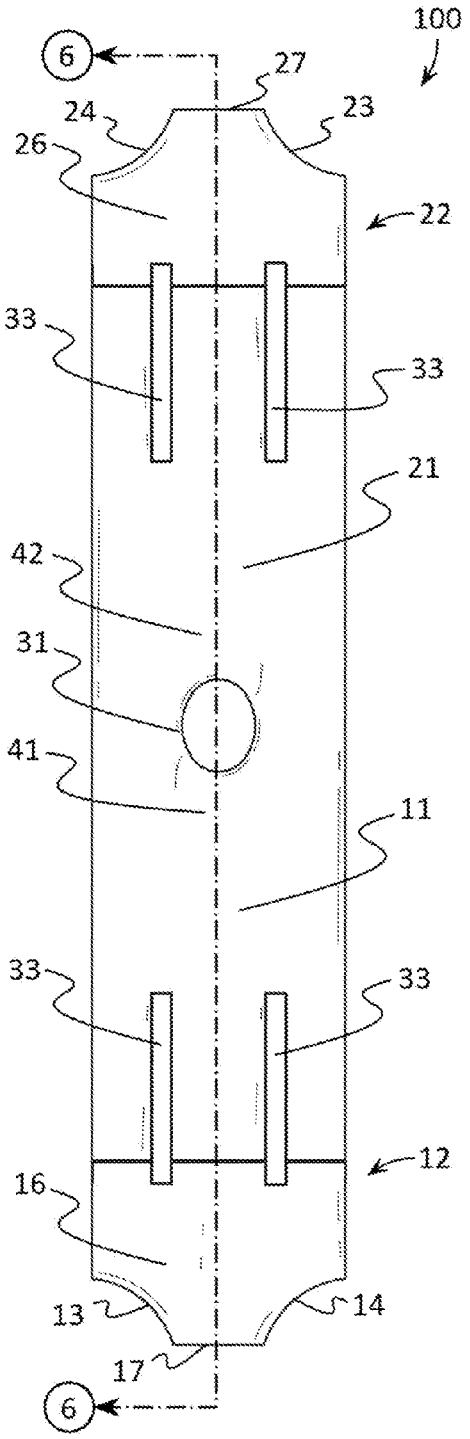
FIG. 5 illustrates a top plan view of another example of a spinning amusement device according to various embodiments described herein.
Figure 6:
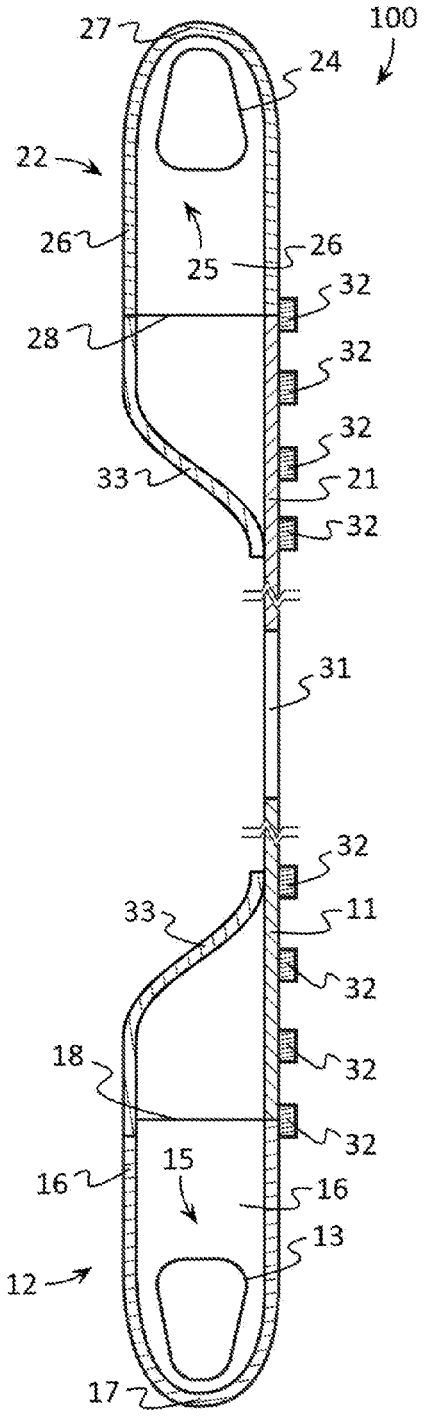
FIG. 6 shows an enlarged sectional, through line 5-5 shown in FIG. 5, elevation view of an example of a spinning amusement device according to various embodiments described herein.

In some embodiments, the device 100 may comprise one or more arms, such as a first arm 11 and a second arm 21 the first arm 11 having a first arm top side (FIG. 1) and an opposing first arm 11 bottom side (FIG. 2) and the second arm 21 having a second arm 21 top side (FIG. 1) and an opposing second arm 21 bottom side (FIG. 2). Preferably, a first arm 11 and a second arm 21 may extend away from each other to position the first seat 12 a desired distance from the second seat 22. In further embodiments, the first seat 12 and second seat 22 may be positioned approximately 6.5 to 9.5 feet, and more preferably approximately 8.0 feet, apart. In still further embodiments, the length of a first arm 11 and/or a second arm 21 may be adjustable to enable the first seat 12 and second seat 22 may be positioned at various distances from each other, such as by comprising one or more adjustable fasteners such as hook and loop type fasteners, side release buckles, buckles, clasps, slides, loops, reducers, cam buckles, strap adjusters, snap hooks, D rings, tri-loops, footman loops, keepers, cord locks, strap locks, or any other suitable fastening method. For example, an arm 11, 21, may comprise a belt having two or more holes or apertures and a belt buckle with a frame and prong, and the prong may be inserted through different holes of the belt to lengthen or shorten the arm 11, 21.

Each arm 11, 21, may comprise or be coupled to a seat 12, 22. In some embodiments, a first arm 11 may comprise or be coupled to a first seat 12 which may be opposingly positioned to a second arm 21 and a second seat 22. A first seat 12 may be configured to receive portions of a child and to support the butt or hindquarters of the child. In some embodiments, a first seat 12 may comprise one or more bottom supports 17 which may support the butt or hindquarters of a child received in the first seat 12. In some embodiments, the first seat 12 may comprise a first seat cavity 15 which may be shaped to receive and support the butt or hindquarters of a child and also portions of the front, back, right side, and/or left side of the torso of the child. In preferred embodiments, a first seat 12 may comprise one or more first seat walls 16 which may be coupled to a bottom support 17 and to the first arm 11. The one or more seat walls 16 may be configured to form portions of the seat cavity 15 which may extend around, and preferably support, portions of the front, back, right side, and/or left side of the torso of a child received in the first seat 12. In some embodiments, a bottom support 17 and a seat wall 16 may be continuous to form a generally continuous first seat cavity 15. In alternative embodiments, a bottom support 17 and/or a seat wall 16 may be formed from one or more straps or other elements so that the bottom support 17 and/or a seat wall 16 may be configured as a harness, such as a climbing harness or the like.

In some embodiments, a first seat 12 may comprise one or more leg apertures 13, 14, and each leg aperture 13, 14, may be configured to receive one or both legs of a child received in the first seat 12. In preferred embodiments, a first seat 12 may comprise a right leg aperture 13 and a left leg aperture 14 with the right leg aperture 13 configured and shaped to receive the right leg and the left leg aperture 14 configured and shaped to receive the left leg of a child received in the first seat 12. In preferred embodiments, a first seat 12 may comprise a bottom support 17 which may separate a right leg aperture 13 from a left leg aperture 14. In other embodiments, a first seat 12 may comprise a bottom support 17 and a single leg aperture 13, 14, so that both legs of a child received in the first seat 12 may extend through the leg aperture 13, 14, while the butt or hindquarters of the child are supported by the bottom support 17.

In some embodiments, a second arm 21 may comprise or be coupled to a second seat 22 which may be opposingly positioned to a first arm 11 and a first seat 12. A second seat 22 may be configured to receive portions of a child and to support the butt or hindquarters of the child. In some embodiments, a second seat 22 may comprise one or more bottom supports 27 which may support the butt or hindquarters of a child received in the second seat 22. In some embodiments, the second seat 22 may comprise a second seat cavity 25 which may be shaped to receive and support the butt or hindquarters of a child and also portions of the front, back, right side, and/or left side of the torso of the child. In preferred embodiments, a second seat 22 may comprise one or more second seat walls 26 which may be coupled to a bottom support 27 and to the second arm 21. The one or more seat walls 26 may be configured to form portions of the seat cavity 25 which may extend around, and preferably support, portions of the front, back, right side, and/or left side of the torso of a child received in the second seat 22. In some embodiments, a bottom support 27 and a seat wall 26 may be continuous to form a generally continuous second seat cavity 25. In alternative embodiments, a bottom support 27 and/or a seat wall 26 may be formed from one or more straps or other elements so that the bottom support 27 and/or a seat wall 26 may be configured as a harness, such as a climbing harness or the like.

In some embodiments, a second seat 22 may comprise one or more leg apertures 23, 24, and each leg aperture 23, 24, may be configured to receive one or both legs of a child received in the second seat 22. In preferred embodiments, a second seat 22 may comprise a right leg aperture 23 and a left leg aperture 24 with the right leg aperture 23 configured and shaped to receive the right leg and the left leg aperture 24 configured and shaped to receive the left leg of a child received in the second seat 22. In preferred embodiments, a second seat 22 may comprise a bottom support 27 which may separate a right leg aperture 23 from a left leg aperture 24. In other embodiments, a second seat 22 may comprise a bottom support 27 and a single leg aperture 23, 24, so that both legs of a child received in the second seat 22 may extend through the leg aperture 23, 24, while the butt or hindquarters of the child are supported by the bottom support 27.

In some embodiments, one or more seats 12, 22, may comprise one or more shoulder straps 33 which may be configured to secure the shoulders and/or other upper portions of the body of a child received in a respective seat 12, 22. A shoulder strap 33 of a first seat 12, 22, may comprise a length of flexible material, such as shock cord, rope, nylon webbing, leather strap, or the like, although any other material may be used. Each shoulder strap 33 may be coupled to an arm 11, 21, and preferably to a seat wall 16, 26 of the respective seat 12, 22. In preferred embodiments, a first seat 12 and a second seat 22 may each comprise two shoulder straps 33 with a first shoulder strap 33 configured to be positioned around or across one shoulder of a child received in a respective seat 12, 22, and the second strap configured to be positioned around or across the other shoulder of a child received in a respective seat 12, 22. In further embodiments, a shoulder strap 33 may be adjustable, such as by comprising one or more adjustable fasteners such as hook and loop type fasteners, side release buckles, buckles, clasps, slides, loops, reducers, cam buckles, strap adjusters, snap hooks, D rings, tri-loops, footman loops, keepers, cord locks, strap locks, or any other suitable fastening method.

In some embodiments, one or more seats 12, 22, may comprise one or more lateral supports 34. Preferably, a lateral support 34 may comprise a length of flexible material, such as shock cord, rope, nylon webbing, leather strap, or the like, although any other material may be used. Optionally, a lateral support 34 may extend, preferably horizontally, around portions of a respective seat 12, 22, such as the upper perimeter 18, 28, of the seat cavity 15, 25, of the respective seat 12, 22, to reinforce the respective seat wall 16, 26, or any other portion of the respective seat 12, 22, and/or arm 11, 21. In further embodiments, a seat 12, 22, may be configured as a harness and may comprise one or more lateral supports 34 which may be configured to extend laterally, or in any other direction, around portions of a child received in the respective seat 12, 22.

In some embodiments, one or more seats 12, 22, may comprise one or more longitudinal supports 35. Preferably, a longitudinal support 35 may comprise a length of flexible material, such as shock cord, rope, nylon webbing, leather strap, or the like, although any other material may be used. Optionally, a longitudinal support 35 may extend, preferably vertically, around portions of a respective seat 12, 22, such from a bottom support 17, 27, to a lateral support 34 of the respective seat 12, 22, to reinforce the seat wall 16, 26, or any other portion of the respective seat 12, 22, and/or arm 11, 21. In further embodiments, a seat 12, 22, may be configured as a harness and may comprise one or more longitudinal supports 35 which may be configured to extend longitudinally, or in any other direction, around portions of a child received in the respective seat 12, 22.

In some embodiments, the device 100 may comprise one or more handles 32 which may positioned proximate to each seat 12, 22. Preferably, one or more handles 32 may be positioned proximate to the first seat 12 on a first arm 11 bottom side (FIG. 2) and one or more handles 32 may be positioned proximate to the second seat 22 on a second arm 21 bottom side (FIG. 2). A handle 32 may comprise a length of flexible material, such as shock cord, rope, nylon webbing, leather strap, or the like, although any other material may be used. Optionally, a one or more handles 32 may positioned proximate to each seat 12, 22, so that a handle 32 proximate the first seat 12 may be grasped by a first hand of an adult having their neck received in the neck aperture 31 and a handle 32 proximate the second seat 22 may be grasped by the other hand of the adult. Preferably, the adult may manipulate the handles 32 to aid in the control of the arms 11, 21, such as when spinning the device 100 with a child received in the first seat 12 and a child received in the second seat 22. By having two or more handles 32 proximate to each seat 12, 22, the adult may grasp the handles 32 that are comfortable for their given arm length. Optionally, the handles may be adjustable, such as by comprising one or more adjustable fasteners such as hook and loop type fasteners, side release buckles, buckles, clasps, slides, loops, reducers, cam buckles, strap adjusters, snap hooks, D rings, tri-loops, footman loops, keepers, cord locks, strap locks, or any other suitable fastening method.

In some embodiments, the device 100 may comprise one or more handle supports 38 which may reinforce the one or more handles 32 and/or reinforce the attachment of the one or more handles 32 to an arm 11, 21. Preferably, a handle support 38 may be coupled to the opposing ends of the handles 32 and preferably link or couple the handles together. A handle support 38 may comprise a length of flexible material, such as shock cord, rope, nylon webbing, leather strap, or the like, although any other material may be used.

The device 100 may comprise a neck aperture 31 which may be disposed centrally between the first arm 11 and the second arm 21. The neck aperture 31 may be configured in any shape and size which may enable the neck of an adult user to be received in the neck aperture 31. Optionally, the neck aperture 31 may be adjustable in size, such as by comprising one or more adjustable fasteners such as hook and loop type fasteners, side release buckles, buckles, clasps, slides, loops, reducers, cam buckles, strap adjusters, snap hooks, D rings, tri-loops, footman loops, keepers, cord locks, strap locks, or any other suitable fastening method, to enable adults having various neck sizes to be received in the neck aperture 31. In some embodiments, a neck aperture 31 may comprise a round or elliptical hole formed at the junction of the first arm 11 and the second arm 21. In alternative embodiments, a neck aperture 31 may comprise any shape which may enable the arms 11, 21, to be positioned on opposite sides of an adult user's neck. For example, a neck aperture 31 may be open and by being configured with a generally "C" shape. In further alternative embodiments, the neck aperture 31 may be disposed closer to one seat 12, 22, than to the other seat 12, 22.

In some embodiments, the device 100 may comprise one or more shoulder rests, such as a first shoulder rest 41 and a second shoulder rest 42. Once the neck of an adult is received in the neck aperture 31, the one or more shoulder rests 41, 42, may rest on portions of the shoulders of the adult. The shoulder rests 41, 42, may distribute weight from a child received in the first seat 12 and a child in the second seat 22 across the shoulders of the adult. A shoulder rest 41, 42, may be positioned proximate to or in contact with the neck aperture 31 and may preferably comprise a flexible material, such as which may be used to form the arms 11, 21, a cushioning material, such as urethane foam, silicone, or any other suitable cushioning material, and/or a rigid materials such as molded plastics.

In preferred embodiments, the device 100 may comprise a generally mirrored configuration so that the first arm 11, first seat 12, and any other element formed by or coupled to the first arm 11 and/or first seat 12 may resemble a mirrored configuration of the second arm 21, second seat 22, and any other element formed by or coupled to the second arm 21 and/or second seat 22.

As perhaps best shown by FIGS. 1-6, and 8, in some embodiments, the first arm 11, the second arm 21, the first seat 12, and/or the second seat 22 may each be formed with or comprise a flexible material. A flexible material may include natural and/or synthetic rubber material such as latex rubber, forms of the organic compound isoprene, Polyacrylate Rubber, Ethylene-acrylate Rubber, Polyester Urethane, a flexible plastic such as high-density polyethylene (HDPE), polyvinyl chloride (PVC), polypropylene (PP), Polystyrene (PS), Polycarbonate (PC), low density polyethylene (LDPE), synthetic fabrics such as polyester, acrylic, nylon, rayon, acetate, spandex, lastex, and Kevlar, and natural fabrics such as coir, cotton, hemp, jute, canvas, flax, leather, linen, ramie, wool, silk, or any other suitable flexible natural or synthetic material including combinations of materials. In preferred embodiments, the first arm 11, the second arm 21, the first seat 12, and/or the second seat 22 may each be formed with a sheet of flexible material. A sheet of flexible material may comprise a thickness dimension that is much smaller than a length or width thickness dimension of the material. For example, a sheet of flexible material may comprise a length of rip-stop nylon fabric and the first arm 11, the second arm 21, the first seat 12, and/or the second seat 22 may be formed by folding back and coupling a portion of each end of the length of rip-stop nylon fabric to form the two seats 12, 22, and then cutting out the neck aperture 31 and the one or more leg apertures 13, 14, 23, 24, of each seat 12, 22.

Figure 7:
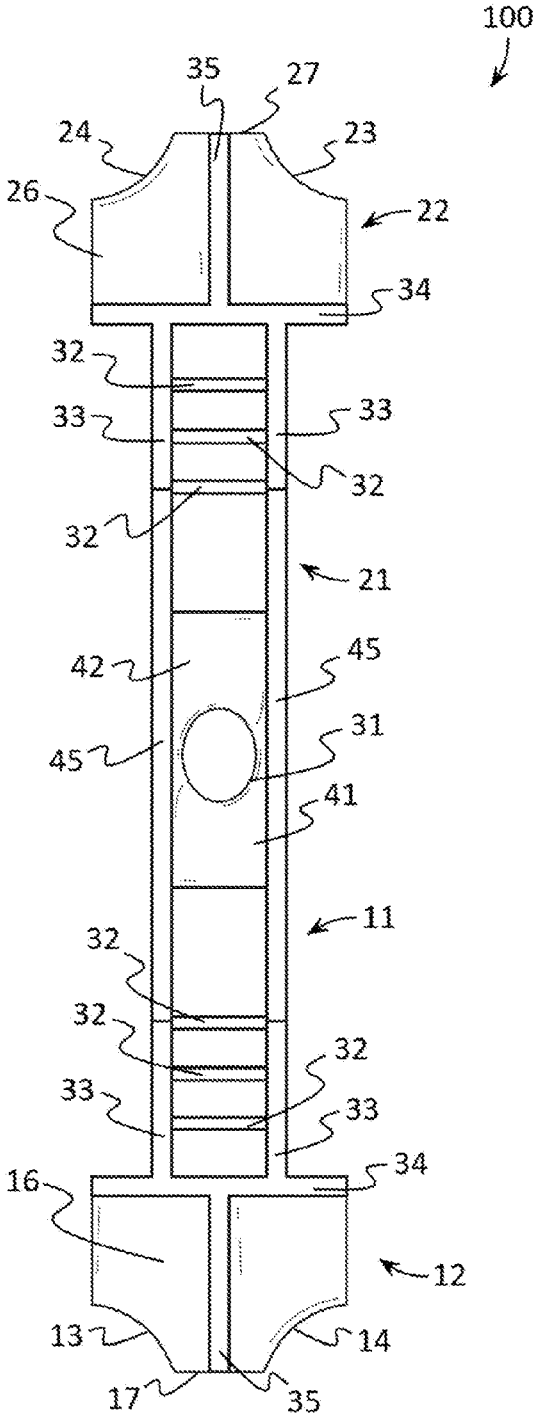
FIG. 7 depicts a top plan view of an alternative example of a spinning amusement device according to various embodiments described herein.

FIG. 7 depicts a top plan view of an alternative example of a spinning amusement device 100 according to various embodiments described herein. In this and in some embodiments, one or more elements of the device 100 may be made from or comprise straps of flexible material such as nylon webbing, polypropylene webbing, polyester webbing, neoprene foam rubber, polyester fabrics, rayon fabrics, and from natural materials and fibers such as cotton webbing, flax webbing, other fabrics, such as flax, coir, cotton, hemp, jute, leather, linen, ramie, wool, silk or any other type of natural or synthetic fibers or materials including combinations of materials. For example, the first arm 11 and second arm 21 may be formed from or with a two arm straps 45 which may be used to couple the first seat 12, to the second seat 22. A first shoulder rest 41, a second shoulder rest 42, and a neck aperture 31 may be disposed between the two arm straps 45.

Figure 8:
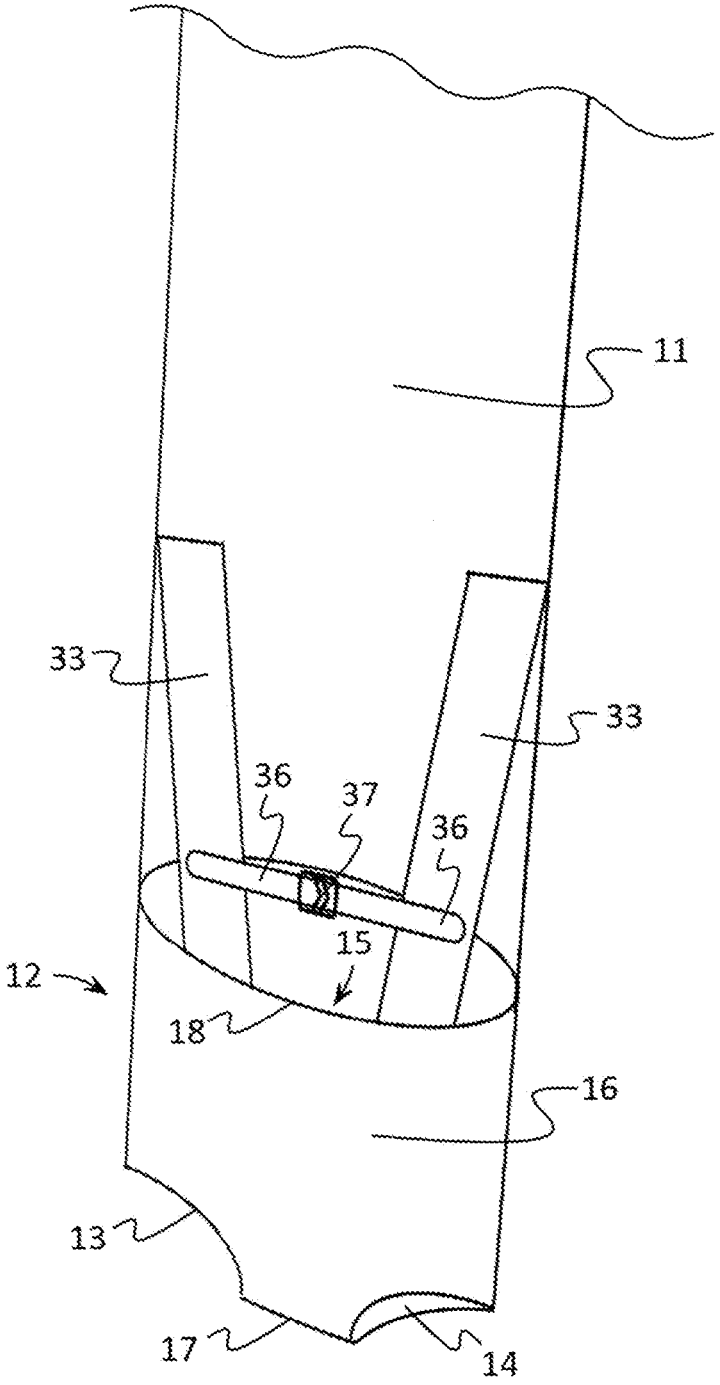
FIG. 8 illustrates a perspective view of a first end of a further example of a spinning amusement device according to various embodiments described herein.

FIG. 8 illustrates a perspective view of a first end of a further example of a spinning amusement device 100 according to various embodiments described herein. In some embodiments, the device 100 may comprise a chest retainer 36 which may be used to couple two shoulder straps 33 of a seat 12, 22, together. Optionally, the chest retainer 36 may comprise a removable fastener 37, such as hook and loop type fasteners, side release buckles, buckles, clasps, slides, loops, reducers, cam buckles, strap adjusters, snap hooks, D rings, tri-loops, footman loops, keepers, cord locks, strap locks, or the like, which may be used to tighten or loosen the shoulder straps 33 and chest retainer 36 to or from a child received in the seat 12, 22.

While some materials have been provided, in other embodiments, the elements that comprise the device 100 such as the arms 11, 21, seats 12, 22, optional seat walls 16, 26, optional bottom supports 17, 27, optional handles 32, optional shoulder straps 33, and/or any other element discussed herein may be made from durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, fabrics, silicone, soft rubbers, or any other suitable materials including combinations of materials. In some embodiments, one or more of the elements that comprise the device 100 may be coupled or connected together with heat bonding, chemical bonding, stitching, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A spinning amusement device, the device comprising:

a. a first arm comprising a flexible material coupled to an opposing second arm comprising a flexible material, the first arm having a first arm top side and an opposing first arm bottom side and the second arm having a second arm top side and an opposing second arm bottom side;

b. a neck aperture disposed centrally between the first arm and the second arm;

c. a first seat coupled to the first arm top side of the first arm;

d. a second seat coupled to the second arm top side of the second arm; and e. a first handle positioned proximate to the first seat on the first arm bottom side and a second handle positioned proximate to the second seat on the second arm bottom side.

2. The device of claim 1, wherein the first seat comprises a first seat wall defining a first seat cavity, and wherein the second seat comprises a second seat wall defining a second seat cavity.

3. The device of claim 1, wherein the first seat comprises a leg aperture, wherein the second seat comprises a leg aperture.

4. The device of claim 1, wherein the first seat comprises a shoulder strap, wherein the second seat comprises a shoulder strap.

5. The device of claim 1, wherein the first arm and the second arm are formed with a sheet of flexible material.

6. The device of claim 1, wherein the first arm, the second arm, the first seat, and the second seat are each formed with a sheet of flexible material.

7. The device of claim 6, wherein the first seat comprises a lateral support and a longitudinal support, and wherein the second seat comprises a lateral support and a longitudinal support.

8. The device of claim 1, further comprising a shoulder pad.

9. The device of claim 1, wherein each seat comprises two shoulder straps, and wherein each seat comprises two leg apertures.

10. A spinning amusement device, the device comprising:

a. a first arm comprising a flexible material coupled to an opposing second arm comprising a flexible material, the first arm having a first arm top side and an opposing first arm bottom side and the second arm having a second arm top side and an opposing second arm bottom side;

b. a neck aperture disposed centrally between the first arm and the second arm;

c. a first seat coupled to the first arm top side, wherein the first seat comprises a first seat wall defining a first seat cavity;

d. a second seat coupled to the second arm top side, wherein the second seat comprises a second seat wall defining a second seat cavity;

e. a first handle and a second handle positioned proximate to the first seat on the first arm bottom side, the first handle and the second handle arranged parallel each other; and f. a third handle and a fourth handle positioned proximate to the second seat on the second arm bottom side, the third handle and the fourth handle arranged parallel to each other.

11. The device of claim 10, wherein the first seat comprises a leg aperture, wherein the second seat comprises a leg aperture.

12. The device of claim 10, wherein the first seat comprises a shoulder strap, wherein the second seat comprises a shoulder strap.

13. The device of claim 10, wherein the first arm and the second arm are formed with a sheet of flexible material.

14. The device of claim 10, wherein the first arm, the second arm, the first seat, and the second seat are each formed with a sheet of flexible material.

15. The device of claim 14, wherein the first seat comprises a lateral support and a longitudinal support, and wherein the second seat comprises a lateral support and a longitudinal support.

16. The device of claim 10, further comprising a shoulder pad.

17. The device of claim 10, wherein each seat comprises two shoulder straps, and wherein each seat comprises two leg apertures.

18. The device of claim 10, further comprising a first handle support coupled to the first arm bottom side and a second handle support coupled to the second arm bottom side.

19. The device of claim 18, wherein the first and the second handles are coupled to the first handle support and the third and the fourth handles are coupled to the second handle support.

* * * * *